United States Patent [19]

Trachtenberg

[11] 4,250,646

[45] Feb. 17, 1981

[54] HIGHWAY SIGN

[76] Inventor: Samuel Z. Trachtenberg, 555 E. 9th Ave., Munhall, Pa. 15120

[21] Appl. No.: 40,590

[22] Filed: May 21, 1979

[51] Int. Cl.[3] ..... G09F 13/16

[52] U.S. Cl. ..... 40/582; 40/561

[58] Field of Search ..... 40/582, 155, 561, 903, 40/612, 615; 340/34, 33, 32; 116/916, 20

[56] References Cited

U.S. PATENT DOCUMENTS

| | | | |
|---|---|---|---|
| 1,298,840 | 4/1919 | Wertz et al. | 40/582 |
| 1,797,221 | 3/1931 | Carter et al. | 40/561 |
| 2,025,818 | 12/1935 | Leigh | 40/561 |
| 2,122,156 | 6/1938 | Schlotz | 40/582 |
| 2,372,124 | 3/1945 | Schenkel | 40/577 |
| 2,426,163 | 8/1947 | Booth | 40/582 |
| 2,614,352 | 10/1952 | MacHarg | 40/615 |
| 2,849,701 | 8/1958 | Clark | 340/32 |
| 2,910,792 | 11/1959 | Pfaff, Jr. | 40/582 |
| 3,176,420 | 4/1965 | Alverson | 40/615 |
| 3,233,217 | 2/1966 | Bost, Jr. | 340/33 |
| 3,283,297 | 11/1966 | Pfennighausen et al. | 340/33 |
| 3,742,897 | 7/1973 | Meek et al. | 40/903 |
| 3,876,940 | 4/1975 | Wickord et al. | 340/33 |
| 3,994,086 | 11/1976 | Mizuochi | 40/582 |
| 4,016,665 | 4/1977 | Sakota | 40/582 |

*Primary Examiner*—Paul J. Hirsch
*Attorney, Agent, or Firm*—William J. Ruano

[57] ABSTRACT

A three-dimensional sign, which may include an angularly disposed perimeter with a mirror-like surface, for reflecting light from the headlights of oncoming vehicles so as to gather light on the sign and make the symbols or letters and background stand out and become easily visable at night. An illusion is created by placing a total accentuated subject or message in a bed of scotch-like retro-reflecting background. Contrasting colors or contrasting density, such as black to white, are provided as well as a border on the figure or numerals of the sign to accentuate the message thereof. This is particularly so if the border is made at least partially of retro-reflective material. The angularly disposed mirror-like perimeter enhances the light on the sign through additional collection of light and redirecting it to the internal retroreflecting and fluorescent materials.

In some situations, the reflective angular border may be eliminated and contrasting symbols, figures etc. may be made more visible in either daylight or by headlights at night by being surrounded by mirror-like strips which, in turn, are surrounded by border strips of contrasting density. The background may be of translucent plastic material.

13 Claims, 6 Drawing Figures

HIGHWAY SIGN

This invention relates to a sign particularly for use on roadways and highways traveled by automotive vehicles.

In the past, attempts have been made to make such signs more visible, particularly at night, by the use of glass beads, prismatic surfaces, contrasting colors, pattern reflections and the like. However, signs embodying these features have had outstanding shortcomings particularly at night since although illuminated by the head-lights of a traveling automobile, they were still not clearly visible at night.

An enormous and shocking number of deer are killed each year, particularly at night, since their habit is to roam the higher hillside during the day and the valleys or lower altitudes at night during which time they cross the highway and the motorist is not warned early enough to slow or stop the vehicle before the deer crosses the highway.

The present invention will greatly minimize such deer slaughter by virtue of the fact that the sign embodying the present invention will, in essence, "jump out" at the auto driver to tell him at a glance all he should know about approaching conditions as contained in deer crossing signs. Indeed the signs when illuminated "spook" or startle the deer so as to discourage crossing of the road when the headlights of the vehicle illuminate the sign.

An object of the present invention is to provide a novel sign construction which is particularly useful on roadways and highways to provide a highly visible message in either symbols or letters, particularly at night by virtue of the light gathering capability of the sign construction.

Another object of the invention is to provide a novel sign having almost unbelievable visibility at night as well as highly improved visibility during the day, which will have the effect of giving an earlier warning to the motorist so as to greatly minimize accidents of motorists as well as to crossing deer and other animals.

Other objects and advantages of the present invention will become more apparent from a study of the following specifications taken with the accompanying drawing wherein.

Figure 1:
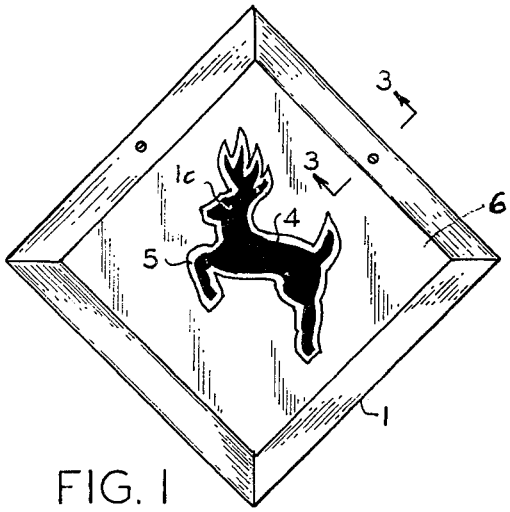
FIG. 1 is a front or elevational view of a sign embodying the features of the present invention.
Figure 2:
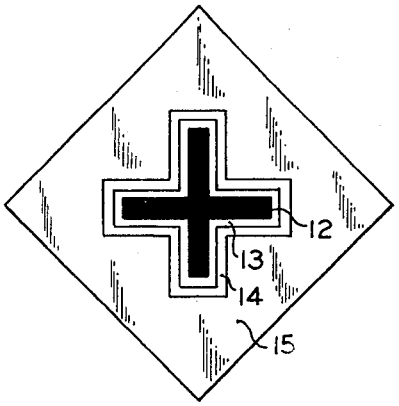
FIG. 2 is a rear view thereof.
Figure 3:
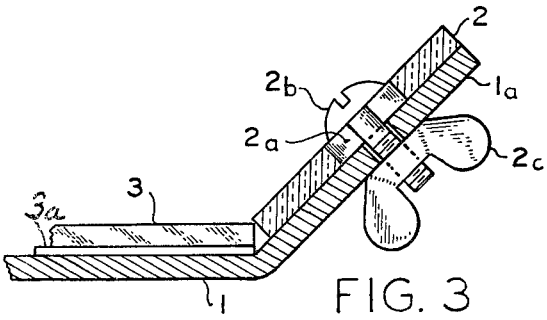
FIG. 3 is an enlarged, cross-sectional view taken along line 3—3 of FIG. 1.

Referring more particularly to FIGS. 1, 2, and 3, numeral 1 denote a sign of rectangular, square or other shape, made of any suitable material, such as aluminum, Corten steel, or other metal or alloys, wood or even plastic material and having the entire perimeter 1*a* disposed at an angle of about 45° or less with respect to the extension of the plane of sign 1 (see Hg. 3). It has been found that a practical range for such angle is from zero (that is, when the border 1*a* is in the same plane as 1) up to about 45° relative the extension of the plane of sign 1. The top or outer surface of the flanged perimeter 1*a* is either smoothly ground and provided with a mirror-like surface, particularly in the case of an aluminum sign, or is in the form of a mirror or highly reflective covering panel or possibly a coating in the case of the use of a steel or metal alloy base. It is preferable to keep the mirror surface of flange 1*a* covered by an abrasion resistant, retroflective plastic material 2. Likewise, in order to preserve the colors of the sign 1 for several years, it is preferable to provide an abrasion resistant plastic covering sheet or coating 3 to protect the exotic materials.

In operation, when the automotive head lights of a motorist shines upon the sign and the mirror surface on flanges 1*a*, the light will be reflected onto either the surface of the sign 1 or the flange 1*a* on the opposite side, bearing in mind that the angle of incidence of the rays from the headlights (and depending upon the direction of the incident rays of light falling on the flanges) will be equal to the angle of reflection. The total effect is to "collect" the light on the surface of the sign, providing a high degree of light amplification thereon which will make an astounding increase in visibility of the message on the sign.

This visibility is greatly improved by providing a sign of contrasting colors (such as the complementary colors) or contrasting density (such as black and white). For example, a red background of the sign will go best with the complementary color green on the border, or a blue background will go best with an adjacent yellow, or blue-green with orange.

In the particular symbol of a deer shown in FIG. 1, the body of the deer 4 could be of yellow and the border 5 may be of blue, a complementary color.

An ideal combination is a black body 4 of the deer with a white outline 5, of contrasting density, to emphasize the shape of the deer, and a red background 6 of the sign 1, particularly since the light from the automobile headlights has a high red intensity. The eye 1*c* may be cut out to expose the red background for contrast. The background 6 preferably of either retro-reflective or phosphorescent material. To prevent solarization or deterioration of the material from the sun, the sign should be covered or coated by an abrasion resistant plastic 3 which is of ultra violet absorbing material preferably having a slightly yellow tinge to give long life to the colors on the signs.

FIG. 2 shows a black cross 12, mirror coated light reflecting bordering strip 13 bordered by red strip 14 on a transparent plastic background 15 backed by yellow paint (or yellow tinted plastic) to give 3 dimensional effect. 13 gives daylight contrast.

It is desirable to make the sign replaceable by a new and different sign from time to time. In such case, 3*a* may be considered as the symbol bearing sign coated or covered with a protective plastic material 3 to absorb ultra violet. The plastic cover 2 may be provided with a keyhole shaped slot 2*a* through which a bolt 2*b* projects tightened by a wing nut 2*c*. Thus, when the sign is to be replaced, wingnut 2*c* is slightly unscrewed to enable upward movement of plastic cover 2, which serves as a stop for the sign, enabling the sign to be easily removed and replaced. After replacement, plastic cover 2 is moved down in butting relationship to serve as a stop to firmly hold the new sign (3*a*) in place.

Figure 4:
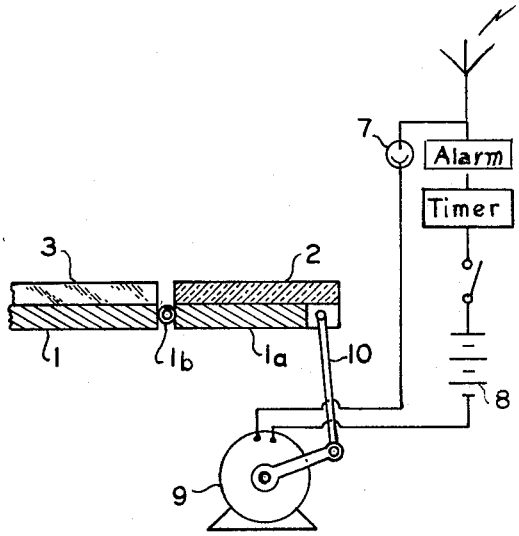
FIG. 4 is a similar view to FIG. 3 of a modification.

FIG. 4 shows a modification wherein perimeter 1*a* is in the same plane as the sign 1. No angular reflection will be provided, however, almost total reflection by the mirror-like surface on flanges 1*a* will accentuate the border.

Perimeter 1*a* is pivotally adjustable to any angle between 0° and 45° such as by a tight fitting hinge 1*b* or any other angular adjusting means to spread the headlight brightness to adjacent areas.

As a further modification of FIG. 4, instead of making a tight fitting hinge 1*b*, it may be made loose fitting and any suitable means may be provided for continuously oscillating or pivoting perimetrical part 1*a* covered by cover 2 from an angle of zero, as shown, to one of perhaps 45° degrees. This will give a varying reflecting light intensity of headlights shining thereon which will be more effective to get the attention of the driver as well as to "spook" deer looking in the direction of the sign so as to frighten the deer away from the highway.

A suitable means for continually oscillating or pivoting part 1*a* only when headlights shine on the sign is to provide a photocell 7 which is triggered by a headlight and which completes a circuit from battery 8 to motor 9, which motor drives a crank shaft 10 which effects continuous oscillation of part 1*a* about the pivot 1*b*.

If sign 1 of FIGS. 3 and 4 is of metal, element 3 may be of transparent plastic material with a painted backing of yellow, for example, a three dimensional effect is obtained of the symbols painted on the outer surface thereof.

In situations where the sign 1 is of translucent plastic material, which may be vacuum formed, such as acrylic, Plexiglass or Lucite, any openings on the symbol carrying part 3*a*, such as the eyes of a deer, will become more visible.

If a translucent background is used, when headlights illuminate it, motorists from the opposite direction will see it and are thus given a warning of the oncoming motorist who might be around a bend or in a position not readily visible. A warning for any type sign may be included in FIG. 4, such as a buzzer or bell alarm or perhaps a radio transmitter, which warning devices are initiated when the headlights illuminates the sign.

In some instances, the perimetrical frame or border 1*a* may be omitted entirely and dependence made solely on the retro-reflecting border on the indicia of the sign, such as figures, numbers letters etc. Perhaps a border of luminescent material in the same plane as the sign may be used. Retro-reflecting material is a paint, substantially transparent to light, containing minute glass or plastic particles or prisms which almost totally reflect light and are of almost powder-like, small size. Red retro-reflecting paint has the characteristic of reflecting back to the driver the light from his headlights which has a high red intensity. There is no after-glow as from luminescent material.

A further modification of FIG. 4, either with or without oscillating frame 1*a*, is to have, in the circuit, an audible alarm or radio transmitter which radiates a beam which may be picked up in the receiver of oncoming motorists from any direction when within a predetermined proximity to the sign. Such alarm warns them of a dangerous condition, such as a railroad crossing, bad curve etc.

A solar battery may be substituted for the battery or 110 volt source 8, so that the solar battery may be recharged from sunlight.

Figure 5:
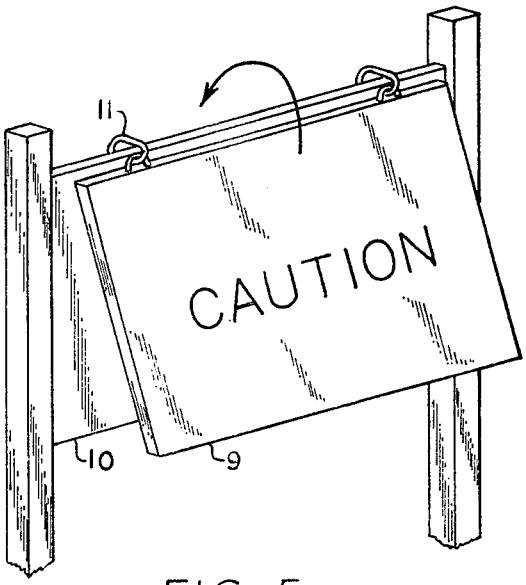
FIG. 5 shows a further modification involving a plural sign panel.

FIG. 5 shows a further modification of the sign and which is of the type that may be mounted in the ground (or on a pole etc.). It comprises a normal sign 10 embodying the present invention and having mounted on top thereof eyes or hooks 11 into which may be inserted the eyes of an alternate sign 9 embodying the present invention. Thus, for example, when some dangerous condition occurs, such as rain or snow, the sign 9 may be quickly flipped over from behind so as to cover sign 10, as shown. Of course, it will be flipped back when the danger no longer exists.

Figure 6:
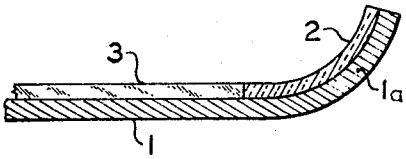
FIG. 6 shows still another modification.

FIG. 6 shows still another modification wherein the perimeter of the sign instead of being flanged is merely upwardly curved slightly having a mirror finish. The sign may be of metal such as steel or steel alloy or aluminum and the perimeter may be provided with a mirror-like polish to serve to reflect light from headlights onto the sign. The curvature should be limited to reflecting light to no more than about 45°, as in FIG. 3.

Thus it will be seen that I have provided a highly efficient and unique sign having an exceedingly high degree of visibility, particularly at night by virtue of the reflection of the perimetrical flanges of mirror finish which collect the light on the sign to provide a bed of scotchlight type retro-reflecting background illuminating the sign. By virtue of the choice of contrasting colors or contrasting density of the colors forming the sign, it has a remarkably high degree of visibility; furthermore, I have provided a highway sign of minimal cost and maintenance, having extremely long life and which can be easily and quickly assembled or replaced by a new sign.

While I have illustrated and described several embodiments of my invention, it will be understood that these are by way of illustration only and that various changes and modifications may be contemplated in my invention and within the scope of the following claims:

I claim:

1. A highway sign comprising an indicia on a color contrasting background, and a narrow strip of retro-reflecting material forming a border between said indicia and background so as to accentuate said border at night when illuminated by headlights of an oncoming vehicle.

2. A sign as recited in claim 1 wherein said indicia and background are of complementary colors and said background is of non-reflective material.

3. A sign as recited in claim 1 wherein said indicia is in the form of a black figure, said border being white and said background being red.

4. A sign as recited in claim 3 wherein a portion of said figure is cut out to expose said red background to pronounce said cut out portion.

5. A sign as recited in claim 1 wherein at least a portion of said background is translucent to allow light from said headlights to pass therethrough and warn motorists driving from an opposite direction.

6. A sign as recited in claim 1 together with a perimetrical frame extending at an angle in excess of zero degrees up to about 45° from an imaginary extension of the plane of said sign, the surface of said perimetrical frame being highly polished and of mirror consistency so as to angularly reflect light from said headlights and collect and concentrate it, at night, on the surface of said sign to accentuate its message.

7. A sign as recited in claim 1 together with an ultra violet filter on said sign to protect the colors of said sign from solarization.

8. A sign as recited in claim 7 wherein said filter is a separate, detachable sheet of transparent plastic material, and wherein said frame is covered with a plastic cover which serves as a stop for holding said sign in place, and means for retracting said plastic filter to enable removal and replacement of said sign.

9. A sign as recited in claim 1 together with a highly polished, narrow mirror-like strip interposed between said retro-reflecting strip and indicia to provide accentuation of said indicia during daylight hours.

10. A sign as recited in claim 6 together with electrically operated signal means responsive to said headlights to alarm oncoming motorists driving from the opposite direction.

11. A sign as recited in claim 10 wherein said signal means is a radio signal which can be picked up by a receiver in any vehicle approaching said sign as a warning of danger.

12. A sign as recited in claim 1 together with an upwardly curved perimetrical frame having a surface which is highly polished and of mirror consistency so as to reflect light from said headlights and collect and concentrate it, at night, on the surface of said sign to accentuate its message.

13. A highway sign comprising an indicia on a color contrasting background, and a narrow strip of retro-reflecting material forming a border between said indicia and background so as to accentuate said border at night when illuminated by headlights of an oncoming vehicle, together with a perimetrical frame extending at an angle in excess of zero degrees up to about 45° from an imaginary extension of the plane of said sign, the surface of said perimetrical frame being highly polished and of mirror consistency so as to angularly reflect light from said headlights and collect and concentrate it, at night, on the surface of said sign to accentuate its message, and electrical means responsive to light from said headlights to oscillate said perimetrical frame throughout said angular range to animate said indicia and sign.

* * * * *